US005935771A

United States Patent [19]

O'Toole et al.

[11] Patent Number: 5,935,771

[45] Date of Patent: Aug. 10, 1999

[54] METHOD OF PROCESSING A SILVER HALIDE PHOTOGRAPHIC ELEMENT WHICH REDUCES FOG

[75] Inventors: Terrence Robert O'Toole, Webster; Daniel Lawrence Kapp, Rochester; Kenneth George Harbison, Rochester; Frank Anthony Pettrone, Rochester; Kenneth Don Fowler, Fairport, all of N.Y.

[73] Assignee: Eastman Kodak Company, Rochester, N.Y.

[21] Appl. No.: 09/092,102

[22] Filed: Jun. 5, 1998

Related U.S. Application Data

[62] Division of application No. 08/616,117, Mar. 14, 1996, Pat. No. 5,811,226.

[51] Int. Cl.[6] ..... G03C 5/305

[52] U.S. Cl. ..... 430/489; 430/486

[58] Field of Search ..... 430/489, 486

[56] References Cited

U.S. PATENT DOCUMENTS

| | | | |
|---|---|---|---|
| 2,271,229 | 1/1942 | Peterson et al. | 430/372 |
| 2,472,627 | 6/1949 | Smith et al. | 430/608 |
| 2,552,229 | 5/1951 | Stauffer et al. | 430/608 |
| 2,566,245 | 8/1951 | Trivelli et al. | 430/608 |
| 3,576,633 | 4/1971 | Henn et al. | 430/355 |
| 4,892,808 | 1/1990 | Harbison et al. | 430/517 |
| 5,141,843 | 8/1992 | Ooms et al. | 430/489 |
| 5,192,647 | 3/1993 | Kojima et al. | 430/489 |
| 5,232,823 | 8/1993 | Morimoto et al. | 430/489 |
| 5,318,881 | 6/1994 | Bucci et al. | 430/489 |
| 5,508,153 | 4/1996 | Ishikawa et al. | 430/489 |
| 5,578,426 | 11/1996 | Nakamura | 430/489 |

FOREIGN PATENT DOCUMENTS 0 597 312 of 0000 European Pat. Off. .

*Primary Examiner*—Hoa Van Le
*Attorney, Agent, or Firm*—Sarah Meeks Roberts

[57] ABSTRACT

This invention relates to a method of preventing fog formation in a silver halide photographic element, said method comprising bringing a silver halide developer solution, or a solution preceding a silver halide developer solution, into contact with a cyanide scavenger by a method other than the seasoning out of the cyanide scavenger from a sensitized silver halide photographic element.

6 Claims, No Drawings

METHOD OF PROCESSING A SILVER HALIDE PHOTOGRAPHIC ELEMENT WHICH REDUCES FOG

CROSS REFERENCE TO RELATED APPLICATION

This is a Divisional of application Ser. No. 08/616,117, filed Mar. 14, 1996 now U.S. Pat. No. 5,811,226.

FIELD OF THE INVENTION

This invention relates to a method of processing a silver halide photographic element which reduces fog. More specifically it relates to the developing step of such a processing method.

BACKGROUND OF THE INVENTION

The shelf-life of silver halide elements can be seriously jeopardized by the action of cyanide under ambient conditions. That is, if a film generates cyanide or comes into contact with cyanide on standing, significant film fogging may occur. For this reason, cyanide scavengers are routinely coated into photographic films. The use of palladium in photographic elements to protect the elements from fog formation caused by hydrogen cyanide generated by carbon black has been described in U.S. Pat. 4,892,808. European Patent Application 0 597 312 A1 describes the use of palladium compounds in photographic elements to protect the elements from fog formation caused by hydrogen cyanide generated by chlorinated s-triazine hardeners and photographically useful chemical compounds containing cyano groups. The use of palladium or platinum containing compounds in photographic elements as a means of protecting the elements from fog formation has also been described in U.S. Pat. Nos. 2,552,229; 2,566,245 and 2,472,627.

With the current invention it has been discovered that fog can also occur during the processing of silver halide photographic elements due to the undesired presence of cyanide ion in the developing solution. The cyanide concentration in developing solutions varies from lab to lab and process to process, and the investigations of the present inventors have shown that levels in excess of 10 micromolar are not unusual in Process C-41 developer. Although the levels observed in the trade certainly present no health concern, this amount of cyanide can cause significant fogging in some photographic films.

There are numerous potential sources of cyanide in a photoprocessing environment. One source is the photographic element itself. Cyanide can be released by the thermal decomposition of triazine compounds and cyano-containing compounds which include many dyes, ultraviolet absorbers, couplers and polymerization initiators; materials that are often found in conventional silver halide photographic elements. The cyanide entrained in the photographic element can be released upon contact with developer and can build up in the developer, a process known as seasoning. It is also possible that some of the cyano-containing compounds coated in the photographic elements can react in developer solutions to yield cyanide. Alternatively, the developer may be contaminated by the local environment or other processing solutions. Cyanide can be generated by photochemical decomposition of ferricyanide (common photographic bleach), by oxidation of thiocyanate (common fix accelerator), and by reaction of hydroxylamine (common developer stabilizer) with formaldehyde (a common image stabilizer). Cyanide also can be found in carbon black materials (commonly used for film antihalation), polyurethanes, paper materials, and biocides. Cyanide is often used in high concentrations in the electrochemical plating of precious metals such as silver.

It has been found by the present inventors that while coated scavengers in a sensitized silver halide element are effective at scavenging cyanide in the ambient environment, they do not provide sufficient protection from cyanide which is present-in photographic developer solutions. Increasing the amount of scavenger coated in the photographic element is generally ineffective at preventing the fog generated by cyanide in developer. Further, it is not always an option to coat more scavenger due to various sensitometric consequences in the photographic element. The small amounts of a coated cyanide scavenger which may unintentionally season out of a photographic element are often insufficient to prevent fogging caused by cyanide in the developer.

Therefore, a need exists for a method of protecting photographic elements from fog generated by cyanide in the photographic developer which is simple and effective and which does not have a detrimental effect on the sensitometry of the photographic element.

SUMMARY OF INVENTION

This invention provides a method of preventing fog formation in a silver halide photographic element, said method comprising bringing a silver halide developer solution, or a solution preceding a silver halide developer solution, into contact with a cyanide scavenger by a method other than the seasoning out of the cyanide scavenger from a sensitized silver halide photographic element into the solution. This invention also provides a developer replenisher, or a component thereof, for a silver halide developer, said replenisher or component containing a cyanide scavenger.

The method of this invention can significantly reduce fog in silver halide photographic elements which is caused by cyanide in a developer solution or a solution preceding the developer. The method is simple, inexpensive and effective and it does not affect the sensitometry of the photographic elements.

DETAILED DISCUSSION OF THE INVENTION

The cyanide scavenger utilized in this invention can be any compound which will effectively scavenge cyanide in developer solution without interfering with the processing of the photographic element and which will not adversely affect the sensitometry of the photographic element. The cyanide scavenger must be water soluble and it must operate under the conditions present in a conventional silver halide developer solution, such as a pH above 8. Not all scavengers which work when coated in a photographic element are effective in a developer solution. For example, the present inventors have found that some metal compounds which are known to bind cyanide do not act as adequate scavengers in a developer solution, including certain complexes and salts of platinum, nickel, iron, copper, and cobalt compounds.

The sensitometric consequence of cyanide in a developer or a prebath to developer is almost always an increase in fog. In negative photographic systems, this is manifest as an increase in density in the unexposed areas, i.e., the D-min. One protocol for testing the efficacy of cyanide scavengers in a developer solution using a color negative film format is shown below.

A color negative film suitable for the test is one that, when processed as described below with the developer containing 10 μM KCN, shows a red, green, or blue D-min increase of 0.04 density units or greater relative to the D-min obtained in a cyanide-free developer. More than one color record may be affected, but it is usually best to use the one that yields the largest density deviation. The test film is processed, using the following protocal, with the developer containing 10 μM KCN and 10 μM of the cyanide scavenger to be tested. The cyanide scavenger may be added as a solid or from a solution concentrate, the latter being preferred for accuracy and simplicity. The cyanide scavenger and the cyanide are usually given at least 5 minutes to react prior to processing. Preferred cyanide scavengers are those which, when combined with cyanide as described above, yield a delta D-min of less than or equal to 0.02 density unites relative to a cyanide-free developer.

Process protocol (all at 37.8° C. except wash which was 35° C.)

| Step | Time (minutes) |
|---|---|
| develop | 3.25 |
| bleach | 4.00 |
| wash | 3.00 |
| fix | 4.00 |
| wash | 3.00 |
| rinse | 1.00 |

Developer composition (per liter):

| | |
|---|---|
| potassium carbonate | 34.3 g |
| potassium hydrogen carbonate | 2.3 g |
| sodium sulfite | 3.7 g |
| potassium iodide | 1.2 mg |
| sodium bromide | 1.3 g |
| hydroxylamine sulfate | 2.4 g |
| KODAK ™ Color Developing Agent CD4 | 4.5 g |
| pH (adj w/sulfuric acid or potassium hydroxide) | 10.05 |

Bleach composition (per liter):

| | |
|---|---|
| acetic acid | 50 mL |
| ammonium bromide | 25.0 g |
| propylenediaminetetraacetic acid | 37.4 g |
| 1,3-diamino-2-propanoltetraacetic acid | 0.8 g |
| ferric ammonium nitrate, nonahydrate | 44.8 g |
| pH (adj w/sulfuric acid or ammonium hydroxide) | 4.75 |

Fixer composition (per liter):

| | |
|---|---|
| sodium metabisulfite | 11.8 g |
| ammonium thiosulfate (56.5% w/w)/ammonium sulfite (4% w/w) solution | 162 mL |
| pH (adj w/sulfuric acid or ammonium hydroxide) | 6.5 |

Rinse composition (per liter):

| | |
|---|---|
| KODAK PHOTO-FLO ™ 200 | 5 mL |

Although this protocol has been defined in terms of a color negative film, the preferred cyanide scavengers are not limited in their use to Process C-41 developer. The inventors herein have observed that scavengers that pass the above protocol generally work in other developers as well. However, analogous test protocols specific to other processes (reversal, motion picture, etc.) can be utilized.

Suitable cyanide scavengers are palladium and gold compounds. Particularly suitable cyanide scavengers are palladium compounds. The palladium compound can be a salt of palladium, a complex salt of palladium, or a neutral complex of palladium and the phrase "palladium in association with" includes all of the above possibilities. Examples of useful palladium compounds include palladium in association with ammonia, an organic amine or polyamine, an aminocarboxylic acid or aminopolycarboxylic acid, an imine or polyimine, an iminocarboxylic acid, a halide ion, a thiol, sulphonic acid, phosphonic acid, carboxylic acid or polycarboxylic acid, thiocyanate ion or a thioether. Some particularly suitable compounds include palladium in association with glycine, ethylenediamine, or diethylenetriaminepentaacetic acid, or a tetrachloropalladate salt. Some specific examples include potassium tetrachloropalladate (II) and bis(ethylenediamine)palladium (II) chloride.

In the present invention, the oxidation state of the palladium should be (II) or (IV), preferably (II). The palladium compound may have a neutral, negative or positive overall charge. When it is an anion or cation, the palladium compound is utilized in association with a cation(s) or anion(s) of sufficient charge to balance the charge of the ion. Halide ions, preferably chloride, or nitrate, sulfate, or acetate ions are normally utilized to balance the charge of the cationic palladium complex, although it is specifically contemplated that any ion(s) of sufficient balancing charge would be practical so long as the counter ions themselves have no sensitometric effect.

The palladium complexes of the invention are commercially available or can be readily synthesized by known methods from commercially available reactants. Bis (ethylenediamine-N,N')palladium (II) chloride can be prepared as described in N. S. Kurnakow and N. J. Gwosdaren, Zeit. anorg. Chem. 22, 384 (1899) and dissolved in water for use in the invention. Alternatively, a solution of bis (ethylenediamine) palladium (II) chloride can be prepared by reacting an aqueous solution of potassium tetrachloropalladate (II) (1 mole) with ethylenediamine (2 moles minimum).

In general, complexes of palladium with ligands containing an amino group can be prepared in solution by reacting potassium or ammonium tetrachloropalladate with an excess of the ligand or salt of the ligand, and neutralizing if necessary. For example, complexes of palladium with glycine can be prepared by reacting a solution of potassium tetrachloropalladate (II) (1 mole) with an excess of glycine (e.g., 5 moles) and neutralizing rapidly to pH 7 with potassium hydroxide. A solution of bis(ethylenediamine) palladium (II) chloride can be prepared by adding ethylenediamine dihydrochloride (2 mole or more) to a solution of potassium tetrachloropalladate (II) (1 mole) and neutralizing rapidly to pH 7 with sodium hydroxide.

The cyanide scavengers are useful when utilized in a silver halide developer solution, or in any solution preceding a silver halide developer, which may contain cyanide (such as a prebath to a developer). Most suitably they will be utilized in a developer solution. The cyanide scavengers may be brought into contact with a developer solution or any solution preceding a developer in any suitable manner. They may be dispensed as a solid directly into a processing tank or into a replenisher solution which is then added to a processing tank. They may be prepared as a liquid concentrate as a separate part for addition directly into a processing tank or into a replenisher solution which is then added to a processing tank. Often a developer solution or a replenisher is prepared in "parts" with each part containing one or more components of the developer solution. The cyanide scavenger may be added to one of these parts. One skilled in the art will be able to determine which part of a replenisher should preferably contain the scavenger depending on the components of each part.

The scavenger may be delivered by running a non-sensitized film which contains the scavenger through the processing tank. The scavenger may be added by release from an ion exchange column connected, for example, in the recirculation system. The scavenger may also be added during the regeneration of the developer solution, or the solution preceding the developer.

The amount of cyanide scavenger which is adequate will depend on the effective stoichiometry of its cyanide binding and on the amount of cyanide, present or anticipated, in the particular system. Although it is known that palladium (II) can strongly bind up to 4 cyanide ions, the present inventors have found that the stoichiometry of palladium:cyanide in a developer solution is usually between 1:1 and 1:2. That is, each palladium (II) ion can effectively bind about one to two cyanide ions. When a palladium compound is utilized, it is preferable to have the concentration of the palladium compound in the developer tank solution or the solution preceding the developer solution at about 1 to 100 micromolar palladium and more preferably at 2 to 50 micromolar palladium.

The scavenger may be delivered as two or more separate compounds which will form the appropriate cyanide scavenger compound in the developer solution. For example, diethylenetriaminepentaacetic acid and ammonium tetrachloropalladate (II) may be added separately to the developer solution. The cyanide scavengers may be used in combination with each other as well as in combination with conventional antifoggants.

The photographic elements suitable for use with this invention may be simple single layer elements or multilayer, multicolor elements. They may also be black-and-white elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art. The silver halide elements may be reversal or negative elements.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The silver halide emulsions utilized may be comprised of any halide distribution. Thus, they may be comprised of silver chloride, silver bromide, silver bromochloride, silver bromoiodide, silver chlorobromide, silver iodochloride, silver iodobromide, silver bromoiddochloride, silver chloroiodobromide, silver iodobromochloride, and silver iodochlorobromide emulsions. Silver bromoiodide emulsions are most typically utilized.

The photographic elements may also contain a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in Research Disclosure, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, and (3) Research Disclosure, September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components of the silver halide elements suitable for use with this invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating |
| 3 | I, II, III, IX A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Wash-out |
| 3 | X | couplers; Dye stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as with electron beam, beta radiation, .gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements. The photographic elements are preferably exposed to actinic radiation, typically in the visible region of the spectrum, to form a latent image, and then chemically processed to form a visible image.

Processing a silver halide color photographic light-sensitive material is basically composed of two steps: 1) color development (for color reversal light-sensitive materials, black-and-white first development is necessary) and 2) desilvering. The step of contacting the element with a color developing agent reduces developable silver halide and oxidizes the color developing agent. Oxidized color developing agent in turn reacts with the coupler to yield a dye. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

The following are non-limiting examples of processing methods:

1) color developing—bleach-fixing—washing/stabilizing;

2) color developing—bleaching—fixing—washing/stabilizing;

3) color developing—bleaching—bleach-fixing—washing/stabilizing;

4) color developing—stopping—washing—bleaching—washing—fixing—washing/stabilizing;

5) color developing—bleach-fixing—fixing—washing/stabilizing;

6) color developing—bleaching—bleach-fixing—fixing—washing/stabilizing.

7) black and white developing—reversal bath—color developing—bleaching—fixing—washing/stabilizing.

8) color developing—stopping—washing—fixing—washing—bleaching—washing—fixing—washing/stabilizing.

9) black and white developing—fixing—washing/stabilizing.

Each of the steps indicated can be used with multistage applications as described in U.S. Pat. No. 4,719,173, with co-current, counter-current, and contraco-contacting arrangements for replenishment and operation of the multistage processor. Any photographic processor known to the art can be used to process the photosensitive materials described herein. For instance, large volume processors, and so-called minilab and microlab processors may be used. Also useful are Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. Nos. 5,294,956; 5,179,404; 5,270,762; 5,313,243; 5,339,131; and European Patent Applications 559,027; 559,025 and 559,026.

Negative-working silver halide elements are processed to provide a negative image. The described elements can be processed in the known C-41 color process as described in *The British Journal of Photography Annual* of 1988, pages 191–198. Motion picture films may be processed as described in Kodak Publication No. H-24, Manual For Processing Eastman Color Films. Where applicable, the element may be processed in accordance with color print processes, such as the RA-4 process of Eastman Kodak Company as described in the *British Journal of Photography Annual* of 1988, pages 198–199, the Kodak Ektaprint 2 Process as described in Kodak Publication No. Z-122, using Kodak Ektaprint chemicals, and the Kodak ECP Process as described in Kodak Publication No. H-24, Manual For Processing Eastman Color Films. To provide a positive (or reversal) image, the color development step can be preceded by development with a non-chromogenic developing agent to develop exposed silver halide, but not form dye, and followed by uniformly fogging the element to render unexposed silver halide developable. For elements that lack incorporated dye image formers, sequential reversal color development with developers containing dye image formers such as color couplers is illustrated by the Kodachrome K-14 process (see U.S. Pat. Nos. 2,252,718; 2,950,970; and 3,547,650). For elements that contain incorporated color couplers, the E-6 color reversal process is described in the *British Journal of Photography Annual* of 1977, pages 194–197. Alternatively, a direct positive emulsion can be employed to obtain a positive image. Processing is preferably carried out in the known Process C-41 (Eastman Kodak Company) or the known Process E-6 (Eastman Kodak Company).

The developing solution can contain organic or inorganic developing agents or mixtures thereof. Representative developing agents are disclosed by T. H. James, *The Theory of the Photographic Process,* 4th Ed., Macmillan, 1977; Chapters 11 and 12, and the references cited therein. Useful classes of organic developing agents include hydroquinones, catechols, aminophenols, ascorbic acid, pyrazolidones, phenylenediamines, tetrahydroquinolines, bis(pyridone) amines, cycloalkenones, pyrimidines, reductones and coumarins. Useful inorganic developing agents include compounds of a metal having at least two distinct valence states, which compounds are capable of reducing ionic silver to metallic silver. Such metals include titanium, vanadium and chromium, and the metal compounds employed are typically complexes with organic compounds such as polycarboxylic acids or aminopolycarboxylic acids. Particularly useful primary aromatic amino color developing agents are the p-phenylenediamines and especially the N,N-dialkyl-p-phenylenediamines in which the alkyl groups or the aromatic nucleus can be substituted or unsubstituted. These p-phenylenediamine derivatives may take salt forms, for example, sulfate, hydrochloride, sulfite, and p-toluenesulfonate salts. The aromatic primary amine color developing agents are generally used in amounts of about 0.1 to 20 grams, preferably about 0.5 to 10 grams per liter of the color developer. Common p-phenylenediamine color developing agents are N,N-diethyl-p-phenylenediamine monohydrochloride, 4-N,N-diethyl-2-methylphenylenediamine monohydrochloride, 4-(N-ethyl-N-2-methanesulfonylaminoethyl)-2-methylphenylenediamine sesquisulfate monohydrate, and 4-(N-ethyl-N-2-hydroxyethyl)-2-methylphenylenediamine sulfate. Other p-phenylenediamines and their use include those described in U.S. Pat. Nos. 5,202,229; 5,223,380; 5,176,987; 5,006,437; 5,102,778; and 5,043,254. Advantageous results can be obtained with combinations of organic and inorganic developing agents as described in *Vought Research Disclosure,* Vol. 150, October, 1976, Item 15034, and with combinations of different types of organic developing agents such as the combination of anhydrodihydroamino reductones and aminomethyl hydroquindnes described in U.S. Pat. No. 3,666,457, the combination of a color developer and a 3-pyrazolidone described in WO 92/10789 and the combination of ascorbic acid and 3-pyrazolidone described in U.K. Patent 1,281,516. Developing agents can be incorporated in photographic elements in the form of precursors.

Preferably, the pH of the developer is in the range of 8.5 to 12, more preferably 9.0 to 11.0. The above mentioned developer solutions may be used at a processing temperature of preferably 25° C. to 55° C. and more preferably from 35° C. to 45° C. Processing time depends on the process and are known to those skilled in the art.

The developer solution normally contains a preservative to protect the color developer from decomposition. Preservatives include sulfites, such as sodium sulfite, potassium sulfite, sodium bisulfite, potassium bisulfite, sodium metabisulfite, potassium metabisulfite, and carbonyl sulfite adducts, hydroxylamine and hydroxylamine derivatives, hydroxamic acids, hydrazines and hydrazides, phenols, hydroxyketones, aminoketones, saccharides, monoamines, diamines, polyamines, quaternary ammonium salts, nitroxy radicals, alcohols, oximes, diamide compounds, and condensed ring-type amines. Preservatives for use with high chloride films are described in U.S. Pat. No. 4,892,804. Examples of other various preservatives are the hydrazines described in U.S. Pat. Nos. 4,801,521 and 4,960,684; European Patent Applications 0 325 276 and 0 325 277, and European Patent Application 0 326 061, the hydroxyketones described in German OLS 3,801,536 and U.K. Patent Application 2,214,322, the hydroxylamines described in U.S. Pat. Nos. 4,800,153; 4,801,516; 4,833,068; 4,837,139; 4,965,176; 5,004,675; 5,066,571; 5,094,937; 5,100,765; 5,178,992; European Patent Application 0 269 740, and European Patent Application 0 315,952, the amines described in U.S. Pat. Nos. 4,798,783 and 4,897,339, the aromatic sulfinic acids described in U.S. Pat. No. 5,204,229, the polyol compounds described in European Patent Application 0 459 103, the amino acids described in European Patent Application 0 530 921 and the compounds discussed in U.S. Pat. No. 5,077,180. The preservative is preferably added in an amount of 0.5 to 10 grams, more preferably 1 to 5 grams per liter of the developer.

An antifoggant in addition to the cyanide scavenger may be used in a developing solution if required. Antifoggants that can be added include alkali metal halides, such as sodium or potassium chloride, sodium or potassium bromide, sodium or potassium iodide, and organic antifoggants, particularly nitrogen-containing heterocyclic compounds such as benzotriazole, 6-nitrobenzimidazole, 4-nitrobenzotriazole, 5-nitrobenzotriazole, 5-chlorobenzotriazole, 5-nitroisoindazole, 5-nitroindazole, 5-methylbenzotriazole, 2-thiazolylbenzimidazole, 2-thiazolylmethylbenzimidazole, indazoles, 6-nitroindazole, hydroxyazindolizine, and adenine. The use in developing solutions of other nitrogen-containing heterocyclics and mercapto nitrogen-containing compounds is described in U.S. Pat. Nos. 4,851,325; 5,110,713; 4,863,836; 4,853,321; and 4,963,475. The use of sulfur-containing ring compounds is described in U.S. Pat. No. 4,842,993.

Various sequestering agents may be added to the developer to prevent precipitation of calcium and magnesium or for improving the stability of the developer. Particularly useful chelating agents are the organic acids, such as aminopolycarboxylic acids, organic phosphonic acids, and phosphonocarboxylic acids, examples of which are nitrilotriacetic acid, diethylenetriaminepentaacetic acid, ethylenediaminetetraacetic acid, N,N,N-trimethylene phosphonic acid, ethylenediamine-N,N,N',N'-tetramethylene phosphonic acid, cyclohexanediaminetetraacetic acid, 1,2-diaminopropanetetraacetic acid, hydroxyethyliminodiacetic acid, glycol ether diaminetetraacetic acid, ethylenediamine ortho-hydroxyphenylacetic acid, 2-phosphonobutane-1,2,4-tricarboxylic acid, 1-hydroxyethylidene-1,1-diphosphonic acid, N,N'-bis(2-hydroxylbenzyltethylenediamine-N,N'-diacetic acid, triethylenetetraaminehexaaacetic acid, 1,3-diamino-2-propanoltetraacetic acid, nitrilotripropionic acid, hydroxyethylenediaminetriacetic acid, catechol-3,4,6-trisulfonic acid, catechol-3,5-disulfonic acid, 5-sulfosalicylic acid, 4-sulfosalicylic acid, β-alaninediacetic acid, and glycinedipropionic acid. Hydroxyalkylidene diphosphonic acid chelating agents can effectively sequester both iron and calcium and may be utilized in combination with small amounts of lithium salts as described in U.S. Pat. No. 3,839,045. Chelating agents may be used in combination, such as the combination of a polyhydroxy compound and an aminocarboxylic acid of U.S. Pat. No. 4,975,357. The use of various chelating agents in a developer is described in U.S. Pat. Nos. 4,835,092; 4,906,554; 4,837,132; 4,873,180; 4,853,318; 5,053,322, Japanese Kokai JP 4,062,545 and European Patent Application 0 528 406.

Buffering agents may be used to maintain the pH of the developer. These may include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), and potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate), as well as other alkali metal carbonates, borates or phosphates.

Water-soluble sulfonated polystyrene may be used to improve the clarity of the developer solution and reduce the tendency for tarring to take place. The developer may contain stain-reducing agents such as triazinyl stilbenes and the compounds of European Patent Application 0 488 217 and anti-bacterial or anti-fungal agents, such as described in European Patent Application 0 330 093. The developer may contain compounds to increase the solubility of the developing agent such as methyl cellosolve, methanol, benzyl alcohol, acetone, dimethyl formamide, cyclodextrin, dimethyl formamide, diethylene glycol, ethylene glycol, and the solubilizing agents described in European Patent Application 0 556 716 and European Patent Application 0 500 370. Nonionic surfactants and anionic, cationic, or amphoteric surfactants such as described in European Patent Application 0 436 947 may be added to the developer. If necessary, various other components may be added to the color developer solution such as dye-forming couplers, development accelerators, competitive couplers, halides, anti-sludging compounds such as described in European Patent Application 0 507 284 and the compounds of European Patent Application 0 514 906. Silver may be removed as described in U.S. Pat. Nos. 5,210,009 and 5,188,662.

More detailed descriptions of useful development solutions and a description of the desilvering stage of processing are described in detail in Section XX *Research Disclosure*, September 1994, Item 36544, and in *Research Disclosure*, February 1995, Item 37038, published by Kenneth Mason Publications, Ltd., Dudley Annex, 12a North Street, Emsworth, Hampshire PO10 7DQ, ENGLAND, the disclosures of which are incorporated herein by reference.

In color development halide ions from the silver halide grains are dissolved into the developer, where they will accumulate. In addition, the color developing agent is consumed by the aforementioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. The use of this invention with such developer replenishers is specifically contemplated. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases, a material will leave the emulsions layers that will have an effect of restraining development, and will be present at a lower concentration in the replenisher or not present at all. In other cases, a material may be contained in a replenisher in order to remove the influence of a materials that will wash out of the photographic light-sensitive material. In still other cases, for example, the buffer, or the concentration of a chelating agent where there may be no consumption, the component in the replenisher is the same or similar concentration as in the processor tank.

Typically, the replenisher has a higher pH to account for the acid that is released during development and coupling reactions so that the tank pH can be maintained at an optimum value. In addition to components that are consumed, components are added to compensate for the dilution of the tank which occurs when the previous solution is carried into the tank by the photographic light-sensitive material. To improve the shelf life stability and lower costs, the developer constituents are often divided into several concentrates (or "parts") which are mixed in the proper ratio prior to use. For example, KODAK FLEXICOLOR Developer Replenisher LORR is divided into three parts: Part A which is an alkaline solution containing carbonate buffer, sodium bromide, sulfite, and a sequestrant; Part B which is an acidic solution containing an antioxidant; and Part C which is also acidic and contains the developing agent. To prepare the replenisher, 80 mL of Part A, 11.2 mL of Part B. and 11.2 mL of Part C are combined and diluted to 1L. Other replenishers may be divided into two parts. Alternatively, the developer parts may be metered directly into the developer solution along with the necessary amount of water for proper dilution.

Developer waste volume and material costs may be reduced by recovering the overflow from the developer tank as it is being replenished and treating the overflow solution in a manner so that the overflow solution can be used again as a replenisher solution. In one operating mode, chemicals are added to the overflow solution to make up for the loss of chemicals from that tank solution that resulted from the consumption of chemicals that occurred during the development reactions. The chemicals can be added as solid components or as aqueous solutions of the component chemicals. Addition of water and the aqueous solutions of the make-up chemicals also have the effect of reducing the concentration of the materials that wash out of the light-sensitive material and are present in the developer overflow. This dilution of materials that wash out of the light-sensitive material prevents concentration of these materials from increasing to concentrations that can lead to undesired photographic effects, reduced solution stability, and precipitates. The method for the regeneration of a developer is described, for example, in Kodak Publication No. Z-130, "Using EKTACOLOR RA Chemicals". If the materials that wash out of the light-sensitive material are found to increase to an objectionable concentration, the overflow solution can be treated to remove the objectionable material. The use of this invention with such developer regeneration methods is also specifically contemplated.

The cyanide scavengers are also useful in solutions which precede the developer solution. Such pre-baths may be used for pre-hardening, removal of antihalation materials, improvement of uniformity in swelling, to introduce materials that affect development, etc.

The following examples illustrate the practice of this invention. They are not intended to be exhaustive of all possible variations of the invention.

EXAMPLES

Example 1

Exposure and Process Protocol for silver halide color negative films

The films were exposed with 5500 K illumination through a 0–4 density, 21-step tablet. The exposure times were 0.04, 0.02 and 0.01 seconds for 100, 200 and 400 speed films, respectively. The processing protocol (known conventionally as Process C-41) and the solution compositions are described below.

Process protocol (all at 37.8° C. except wash which was 35° C.)

| Step | Time (minutes) |
|---|---|
| develop | 3.25 |
| bleach | 4.00 |
| wash | 3.00 |
| fix | 4.00 |
| wash | 3.00 |
| rinse | 1.00 |

Developer composition (per liter):

| | |
|---|---|
| potassium carbonate | 34.3 g |
| potassium hydrogen carbonate | 2.3 g |

-continued

| | |
|---|---|
| sodium sulfite | 3.7 g |
| potassium iodide | 1.2 mg |
| sodium bromide | 1.3 g |
| hydroxylamine sulfate | 2.4 g |
| KODAK ™ Color Developing Agent CD4 | 4.5 g |
| pH (adj w/sulfuric acid or potassium hydroxide) | 10.05 |
| Bleach composition (per liter): | |
| acetic acid | 50 mL |
| ammonium bromide | 25.0 g |
| propylenediaminetetraacetic acid | 37.4 g |
| 1,3-diamino-2-propanoltetraacetic acid | 0.8 g |
| ferric ammonium nitrate, nonahydrate | 44.8 g |
| pH (adj w/sulfuric acid or ammonium hydroxide) | 4.75 |
| Fixer composition (per liter): | |
| sodium metabisulfite | 11.8 g |
| ammonium thiosulfate (56.5% w/w)/ammonium sulfite (4% w/w) solution | 162 mL |
| pH (adj w/sulfuric acid or ammonium hydroxide) | 6.5 |
| Rinse composition (per liter): | |
| KODAK PHOTO-FLO ™ 200 | 5 mL |

Example 2

In this example various brands of color negative films were exposed and processed using the above protocol, but with three different developer solutions: 1) fresh developer (check); 2) developer containing 20 $\mu$M cyanide ion (obtained by adding 1.05 mL of a stock solution containing 0.019 M KCN and 0.038 M $K_2CO_3$ per liter of developer); and 3) developer containing 20 $\mu$M cyanide ion and 10 $\mu$M of a palladium salt (obtained by adding 0.52 mL of a 0.019 M solution of ammonium tetrachloropalladate per liter of the developer). Table 1 shows the changes in minimum densities (ΔD-min) relative to those obtained in fresh developer. The fogging action of cyanide ion is evidenced by the unwanted increase in D-min. All films are sensitive to cyanide ion in developer to varying degrees. In all cases, however, the fog is eliminated by adding the palladium salt to the developer. The palladium efficiently scavenges the cyanide ion even at sub-stoichiometric levels.

TABLE 1

ΔD-mins (relative to fresh developer) for various films upon adding cyanide and palladium to Process C-41 developer as described in Example 2

| Film | color | Comparison 20 $\mu$M CN alone | Example 2 20 $\mu$M CN plus 10 $\mu$M Pd |
|---|---|---|---|
| KODAK GOLD SUPER 200 Film | red | 0.10 | 0.01 |
| | green | 0.07 | 0.01 |
| | blue | 0.08 | 0.00 |
| SCOTCH 100 Film | red | 0.01 | −0.01 |
| | green | 0.04 | 0.00 |
| | blue | 0.01 | 0.00 |
| AGFACOLOR HDC 100 Film | red | 0.01 | 0.00 |
| | green | 0.01 | 0.01 |
| | blue | 0.04 | 0.01 |
| KONICA VX 100 Film | red | 0.04 | 0.00 |
| | green | 0.00 | 0.00 |
| | blue | 0.04 | 0.02 |

TABLE 1-continued

ΔD-mins (relative to fresh developer) for various films upon adding cyanide and palladium to Process C-41 developer as described in Example 2

| Film | color | Comparison 20 $\mu$M CN alone | Example 2 20 $\mu$M CN plus 10 $\mu$M Pd |
|---|---|---|---|
| FUJICOLOR SUPER G PLUS 100 | red | 0.06 | 0.01 |
| | green | 0.06 | 0.00 |
| | blue | 0.01 | 0.01 |
| FUJICOLOR SUPER G PLUS 400 | red | 0.09 | 0.01 |
| | green | 0.07 | 0.01 |
| | blue | 0.01 | 0.00 |

Example 3

In this example the efficacy of cyanide scavenging by a palladium complex is detailed at various levels of cyanide and palladium in Process C-41 developer. The film was exposed and processed as shown in Example 1, except for the varying levels of cyanide and palladium described in Table 2. The palladium complex was added from a solution containing 0.019 M ammonium tetrachlorpalladate (II) and 0.038 M ethylenediamine at pH=7.

The red ΔD-mins for KODAK GOLD SUPER 200 Film are shown (relative to fresh developer) in Table 2. It is seen that this palladium complex is capable of scavenging multiple cyanide ions (about 2 CN per Pd) and that, in the absence of cyanide, the palladium has no adverse sensitometric effect.

TABLE 2

Red ΔD-mins (relative to fresh C-41 developer) for KODAK GOLD SUPER 200 Film from Example 3

| | Palladium complex, $\mu$M | | | | |
|---|---|---|---|---|---|
| [KCN], $\mu$M | 0 | 1 | 2 | 5 | 10 |
| 0 | 0.00 (check) | 0.00 | 0.00 | 0.00 | 0.00 |
| 1 | 0.00 | 0.00 | 0.00 | 0.00 | 0.00 |
| 2 | 0.00 | 0.00 | 0.00 | 0.00 | 0.00 |
| 5 | 0.02 | 0.01 | 0.00 | 0.00 | 0.00 |
| 10 | 0.05 | 0.04 | 0.02 | 0.00 | 0.00 |
| 20 | 0.11 | 0.11 | 0.09 | 0.03 | 0.01 |

Example 4

The efficacy of various palladium complexes to scavenge cyanide in developer solutions is shown in this example. First, palladium complex stock solutions were prepared by reacting ammonium tetrachloropalladate (II) with the ligand of interest, usually in a metal/ligand molar ratio of ⅓ and at a pH of about 7±1. There were a couple of exceptions: for ammonium hydroxide, the metal/ligand ratio was 1/10 and the pH was 10; and for triethylenetetramine the metal/ligand ratio was 1/1. Next, to a Process C-41 developer solution containing 10 $\mu$M KCN, enough of palladium complex stock solution was added to yield a palladium concentration of 10 $\mu$M. The exposure and processing protocol used was as described in Example 1.

The red ΔD-mins (relative to fresh C-41 developer) for KODAK GOLD SUPER 200 Film are shown in Table 3. It is clear that a variety of ligands can be used successfully including aminocarboxylic acids, aminopolycarboxylic acids, imines, iminocarboxylic acids iminopolycarboxylic acids, carboxylic acids, ammonia, amines, polyamines, and phosphonates.

TABLE 3

Red ΔD-mins from Example 4

| [KCN], (μM) | [Pd], (μM) | ligand | Red ΔD-min |
|---|---|---|---|
| 0 | 0 | none | 0.00 (check) |
| 10 | 0 | none | 0.06 (comparison) |
| 10 | 10 | none | 0.00 |
| 10 | 10 | ethylenediaminetetraacetic acid | 0.01 |
| 10 | 10 | propylenediaminetraacetic acid | 0.00 |
| 10 | 10 | 2,2'-bipyridine | 0.00 |
| 10 | 10 | 2,6-pyridinedicarboxylic acid | 0.01 |
| 10 | 10 | 2-pyridinecarboxylic acid | 0.00 |
| 10 | 10 | ethylenediaminedisuccinic acid | 0.01 |
| 10 | 10 | methyliminodiacetic acid | 0.00 |
| 10 | 10 | nitrilotriacetic acid | 0.01 |
| 10 | 10 | glycine | 0.00 |
| 10 | 10 | triethylenetetramine | 0.00 |
| 10 | 10 | oxalate | 0.00 |
| 10 | 10 | malonate | 0.01 |
| 10 | 10 | citrate | 0.00 |
| 10 | 10 | dimethylglyoxime | 0.01 |
| 10 | 10 | 3,5-disulfocatechol, disodium salt | 0.01 |
| 10 | 10 | triethanolamine | 0.01 |
| 10 | 10 | 1-dihydroxyethylidene-1,1-diphosphonic acid | 0.01 |
| 10 | 10 | ammonium hydroxide | 0.01 |

Example 5

Metals and metal complexes other than those involving palladium are known to bind cyanide ion to various degrees. They were investigated for their ability to scavenge cyanide in Process C-41 developer solutions using the protocol of Example 1. The studies were performed in a fashion similar to that reported in Example 4. The final concentrations of metals and optional ligands in the cyanide-laden developers are shown Table 4.

The red ΔD-mins (relative to fresh developer) for KODAK GOLD SUPER 200 Film are shown below. It is readily apparent that, of the numerous salts and complexes tried, only the gold salt appears to be active enough to bind cyanide at such low levels. Even the platinum salt, normally an excellent cyanide scavenger under film-keeping conditions, failed to perform adequately in this color..developer solutions.

TABLE 4

Red ΔD-mins from Example 5

| [KCN], μM | metal | [metal], μM | ligand | [ligand], μM | Red ΔD-min |
|---|---|---|---|---|---|
| 0 | none | 0 | none | 0 | 0.00 (check) |
| 10 | none | 0 | none | 0 | 0.06 (comparison) |
| 10 | $(NH_4)AuCl_4$ | 10 | none | 0 | 0.00 |
| 10 | $(NH_4)_2PtCl_4$ | 10 | none | 0 | 0.06 |
| 10 | $Fe(NH_4)_2(SO_4)_2$ | 10 | 2,2'-bipyridine | 30 | 0.07 |
| 10 | $Fe(NH_4)_2(SO_4)_2$ | 10 | 3,5-disulfo-catechol, disodium salt | 30 | 0.06 |

TABLE 4-continued

Red ΔD-mins from Example 5

| [KCN], μM | metal | [metal], μM | ligand | [ligand], μM | Red ΔD-min |
|---|---|---|---|---|---|
| 10 | $Ni(CH_3CO_2)_2$ | 10 | dimethyl glyoxime | 30 | 0.05 |
| 20 | none | 0 | none | 0 | 0.12 (comparison) |
| 20 | $CuSO_4$ | 10 | none | 0 | 0.11 |
| 20 | $FeSO_4$ | 10 | none | 0 | 0.11 |
| 20 | $Al_2(SO_4)_3$ | 10 | none | 0 | 0.11 |
| 20 | $Co(NO_3)_2$ | 10 | none | 0 | 0.11 |
| 20 | $MnCl_2$ | 10 | none | 0 | 0.11 |
| 20 | $AgNO_3$ | 10 | none | 0 | 0.11 |
| 20 | $ZnCl_2$ | 10 | none | 0 | 0.12 |
| 20 | $Ni(CH_3CO_2)_2$ | 10 | none | 0 | 0.11 |
| 20 | $VOSO_4$ | 10 | none | 0 | 0.12 |

Example 6

This example demonstrates the effectiveness of palladium compounds in preventing fog in reversal silver halide elements. KODAK EKTACHROME 64 Professional Film was exposed with 5500 K illumination through a 0–3 density, 21-step tablet. The process protocol and chemistry used for processing the film, known conventionally as a reversal process or Process E-6, is shown below. The process was carried out at 36.9° C. The fogging action of 20 μM KCN and the cyanide scavenging activity of 10 μM of a palladium complex were assessed by adding them to the first (black-and-white) developer. The palladium complex was added from a solution containing 0.019 M ammonium tetrachlorpalladate (II) and 0.038 M ethylenediamine at pH=7.

The results are shown in Table 5. In Process E-6, silver halide fogging in the first developer is manifest as a decrease in maximum color density, D-max. It is readily evident that cyanide fogs reversal film and that adding the palladium salt to the developer eliminates the fog.

Process E-6

| Step | time (minutes) |
|---|---|
| first developer (black-and-white) | 6 |
| water wash | 2 |
| reversal bath | 2 |
| second developer (color) | 6 |
| prebleach | 2 |
| bleach | 6 |
| fix | 4 |
| wash | 4 |
| rinse | 1 |

First developer composition (per liter):

| | |
|---|---|
| potassium carbonate | 14.0 g |
| potassium hydrogen carbonate | 12.0 g |
| potassium sulfite (45% w/w) | 66.1 g |
| potassium iodide | 4.5 mg |
| sodium bromide | 2.3 g |
| aminotris(methylenephosphonic acid), pentasodium salt (40% w/w) | 1.4 g |
| diethylenetriaminepentaacetic acid, pentasodium salt (40% w/w) | 6.3 g |
| sodium thiocyanate | 1.0 g |
| potassium hydroquinone sulfonate | 23.4 g |
| 4-hydroxymethyl-4-methyl-1-phenyl-3-pyrazolidinone | 1.5 g |
| pH (adj w/acetic acid or potassium hydroxide) | 9.60 |

-continued

| Reversal bath composition (per liter) | |
|---|---|
| propionic acid | 11.9 mL |
| stannous chloride | 1.6 g |
| p-aminophenol | 0.5 mg |
| aminotris(methylenephosphonic acid), pentasodium salt (40% w/w) | 21.1 g |
| Hyamine 1622 ™ (50% solution) | 10 mg |
| pH | 5.75 |
| **Second developer composition (per liter):** | |
| aminotris(methylenephosphonic acid), pentasodium salt (40% w/w) | 6.7 g |
| phosphoric acid (70% w/w) | 17.4 |
| potassium hydroxide (45% w/w) | 61.6 g |
| sodium sulfite | 6.5 g |
| potassium iodide | 37.5 mg |
| sodium bromide | 0.6 g |
| citrazinic acid | 0.6 g |
| 3,6-dithia-1,8-octanediol | 0.9 g |
| KODAK ™ Color Developing Agent CD-3 | 10.4 g |
| pH (adj w/acetic acid or potassium hydroxide) | 11.75 |
| **Prebleach composition (per liter):** | |
| potassium sulfite | 9.0 g |
| ethylenediaminetetraacetic acid | 8.0 g |
| thioglycerol | 0.5 g |
| sodium formaldehyde bisulfite | 60 g |
| pH | 6.15 |
| **Bleach composition (per liter):** | |
| potassium nitrate | 25.0 g |
| ammonium bromide | 64.2 g |
| ammonium ferric ethylenediaminetetraacetic acid complex (44% w/w with 10% molar excess of ethylenediaminetetraacetic acid) | 284.0 g |
| hydrobromic acid (48% w/w) | 51.2 g |
| potassium hydroxide (45% w/w) | 3.9 g |
| ethylenediaminetetraacetic acid | 4.0 g |
| pH | 5.8 |
| **Fixer composition (per liter):** | |
| sodium metabisulfite | 7.1 g |
| ethylenediaminetetraacetic acid | 0.6 g |
| sodium hydroxide (50% w/w) | 2.0 g |
| ammonium thiosulfate (56.5% w/w)/ ammonium sulfite (4% w/w) solution | 162 mL |
| pH | 6.6 |
| **Rinse composition (per liter):** | |
| KODAK PHOTO-FLO ™ 200 | 5 mL |

TABLE 5

Maximum density data for KODAK EKTACHR0ME 64 Professional Film as described in Example 6. Cyanide and palladium complex added to first developer

| [KCN], μM | [Pd], μM | Red D-max | Green D-max | Blue D-max |
|---|---|---|---|---|
| 0 | 0 | 3.24 | 3.46 | 3.32 |
| 20 | 0 | 3.00 | 3.31 | 3.05 |
| 20 | 10 | 3.25 | 3.47 | 3.35 |

Example 7

This example demonstrates the effectiveness of palladium compounds in preventing fog in film used for motion picture color film. EASTMAN Color Negative Film was exposed with 5500 K illumination through a 0–3 density, 21-step tablet. The process protocol and chemistry, known conventionally as Process ECN-2, which was used for processing the EASTMAN Color Negative Film is shown below. The process was carried out at 41.1° C. The fogging action of 10 μM KCN and the cyanide scavenging activity of 10 μM of a palladium complex were assessed by adding them to the developer. The palladium complex was added from a solution containing 0.019 M ammonium tetrachlorpalladate (II) and 0.095 M glycine at pH=7.

The results are shown in Table 6. The fogging action of cyanide ion is evidenced by the unwanted increase in minimum density levels (ΔD-min) relative to the D-mins obtained in fresh developer. It is readily evident that cyanide fogs motion picture film and that adding the palladium complex to the developer eliminates the fog.

Motion picture color negative film process sequence

| Step | Time (minutes) |
|---|---|
| remjet-softening prebath | 0.25 |
| water wash | 0.25 |
| develop | 3.25 |
| stop | 0.50 |
| wash | 0.50 |
| bleach | 3.00 |
| wash | 1.00 |
| fix | 1.00 |
| wash | 1.00 |
| rinse | 0.20 |

| Remjet-softening prebath composition (per liter) | |
|---|---|
| sodium borate decahydrate | 20.0 g |
| sodium sulfate | 100.0 g |
| pH | 9.25 |
| **Developer composition (per liter):** | |
| sodium carbonate | 30.0 g |
| sodium hydrogen carbonate | 1.2 g |
| sodium sulfite | 2.0 g |
| sodium bromide | 1.2 g |
| 3,5-dinitrobenzoic acid | 0.2 g |
| aminotris(methylenephosphonic acid), pentasodium salt (40% w/w) | 2.0 mL |
| KODAK ™ Color Developing Agent CD-3 | 4.0 g |
| pH (adj w/sulfuric acid or sodium hydroxide) | 10.2 |
| **Stop bath composition (per liter)** | |
| concentrated sulfuric acid | 10.0 mL |
| pH | 0.90 |
| **Bleach composition (per liter):** | |
| potassium ferricyanide | 40.0 g |
| sodium bromide | 25.0 g |
| pH (adj w/sulfuric acid or sodium hydroxide) | 6.5 |
| **Fixer composition (per liter):** | |
| sodium metabisulfite | 8.4 g |
| sodium sulfite | 10.0 g |
| ammonium thiosulfate (56.5% w/w)/ ammonium sulfite (4% w/w) solution | 182 mL |
| pH | 6.5 |
| **Rinse composition (per liter):** | |
| KODAK PHOTO-FL0 ™ 200 | 5 mL |

TABLE 6

ΔD-mins (relative to fresh ECN-2 developer) for EASTMAN Color Negative Film upon adding cyanide and a palladium complex to the developer, as described in Example 6

| [KCN], μM | [Pd], μM | Red ΔD-min | Green ΔD-min | Blue ΔD-min |
|---|---|---|---|---|
| 0 | 0 | 0 (check) | 0 (check) | 0 (check) |
| 10 | 0 | +0.12 | +0.24 | +0.02 |
| 10 | 10 | 0.00 | −0.01 | −0.01 |

The invention has been described in detail with particular reference to the preferred embodiments thereof, but it will be understood that variations and modifications can be effected within the scope of the invention.

What is claimed is:

1. A developer replenisher, or a component thereof, for a silver halide developer, said replenisher or component containing a cyanide scavenger.

2. The replenisher of claim 1 wherein the cyanide scavenger is a palladium or a gold compound.

3. The replenisher of claim 2 wherein the cyanide scavenger is a palladium compound.

4. The replenisher of claim 3 wherein the palladium compound is palladium in association with ammonia, an organic amine or polyamine, an aminocarboxylic acid or aminopolycarboxylic acid, an imine or polyimine, an iminocarboxylic acid, a halide ion, a thiol, sulphonic acid, phosphonic acid, carboxylic acid or polycarboxylic acid, thiocyanate ion or a thioether.

5. The replenisher of claim 4 wherein the palladium compound is palladium in association with glycine, ethylenediamine, or diethylenetriamine-pentaacetic acid.

6. The replenisher of claim 4 wherein the palladium compound is a tetrachloropalladate (II) salt.

* * * * *